US007408433B1

(12) United States Patent
Irwin

(10) Patent No.: US 7,408,433 B1
(45) Date of Patent: Aug. 5, 2008

(54) ELECTROMAGNETICALLY ACTUATED BISTABLE MAGNETIC LATCHING PIN LOCK

(75) Inventor: James C. Irwin, Beavercreek, OH (US)

(73) Assignee: Saia-Burgess Inc., Vandalia, OH (US)

( * ) Notice: Subject to any disclaimer, the term of this patent is extended or adjusted under 35 U.S.C. 154(b) by 0 days.

(21) Appl. No.: 11/652,622

(22) Filed: Jan. 12, 2007

(51) Int. Cl.
*H01F 7/08* (2006.01)

(52) U.S. Cl. ..... 335/228; 335/229; 335/234; 335/272

(58) Field of Classification Search ..... 335/228–234, 335/272
See application file for complete search history.

(56) References Cited

U.S. PATENT DOCUMENTS 4,691,135 A * 9/1987 Sogabe et al. ..... 310/254
4,855,700 A 8/1989 Mohler
5,337,030 A 8/1994 Mohler
6,507,257 B2 1/2003 Mohler
6,756,873 B2 6/2004 Mohler

* cited by examiner

*Primary Examiner*—Ramon M. Barrera
(74) *Attorney, Agent, or Firm*—Nixon & Vanderhye P.C.

(57) ABSTRACT

A pin lock is movably mounted for linear movement along a longitudinal axis. A magnet, preferably a permanent magnet, is mounted for limited rotation between the pin extended and pin retracted positions. An electromagnet provides a controllable electromagnetic field which encompasses at least a portion of the permanent magnet. A ferromagnetic latch is located within the magnetic field of the mounted magnet in each of the pin extended and pin retracted positions. A mechanical interconnection between the pin lock and the permanent magnet for moving the pin lock when the permanent magnet is rotated wherein the movement extends or retracts the pin lock between its pin extended and pin retracted positions. Reversing the electromagnetic field of the electromagnet serves to rotate the magnet so that the pin lock moves from one to the other of the two positions.

20 Claims, 6 Drawing Sheets

ELECTROMAGNETICALLY ACTUATED BISTABLE MAGNETIC LATCHING PIN LOCK

BACKGROUND OF THE INVENTION

1. Field of the Invention

The present invention generally relates to locking pins which move between extended and retracted positions. More specifically, the present invention relates to locking pins which when extended prevent movement of another component in at least one lateral direction.

2. Discussion of Prior Art

The existence of electromagnetically actuated pin locks is well known. Typically such locks are in the form of an electromagnetically actuated solenoid which when actuated overcomes the bias of a spring and extends a pin which engages some structure and prevents lateral movement of the structure. Alternatively, the electromagnetically actuated pin lock may be biased by a spring into its extended position and actuation of the electromagnet solenoid serves to retract the pin. For example, many motor vehicles have a pin locking the transmission into the "park" position, thereby preventing movement of the vehicle. However, when the vehicle engine has been started and the operator steps on the brake, that energizes the electromagnet solenoid which retracts the pin lock and allows the operator to move the transmission out of "park."

Another well known linear pin lock is an electromagnetically actuated solenoid having two coils. The movement between the two positions is controlled by actuating the appropriate coil. At each position, there is also a permanent magnet to hold the pin lock in that position, until an actuated coil generates an attractive force that overcomes the magnetic latch and allows the pin to move to the other position.

There are other situations in which it is desirable to be able to electromagnetically actuate the pin lock to either extend or retract or both, but have the lock restrained in either position without continuing to provide power to the electromagnetic solenoid.

It is also highly desirable that in one or both of the retracted and extended positions, the pin lock be constructed such that shocks or forces in a longitudinal direction on the pin lock cannot dislodge the pin lock from its "latched" extended or retracted position.

SUMMARY OF THE INVENTION

The above and other objects are achieved by the present invention in which a pin lock is movably mounted for linear movement along a longitudinal axis. A magnet, preferably a permanent magnet, is mounted for limited rotation between the pin extended and pin retracted positions. An electromagnet serves to provide a controllable electromagnetic field which encompasses at least a portion of the permanent magnet. A ferromagnetic latch is located within the magnetic field of the mounted magnet in each of the pin extended and pin retracted positions. Finally, there is a mechanical interconnection between the pin lock and the permanent magnet for moving the pin lock when the permanent magnet is rotated wherein said movement extends or retracts the pin lock between its pin extended and pin retracted positions. Reversing the electromagnetic field of the electromagnet serves to rotate the magnet so that the pin lock moves from one to the other of said two positions.

In preferred embodiments, the ferromagnetic material of the latch causes attraction by the magnet which holds the magnet in one or both of the pin extended and pin retracted positions. Additionally, in preferred embodiments, the mechanical interconnection includes a structural interrelationship in which at the pin extended and/or the pin retracted position, pressure along the longitudinal axis of the pin lock does not provide any rotational force to the permanent magnet.

BRIEF DESCRIPTION OF THE DRAWINGS

The above and other advantages of the invention will become more apparent from the following description taken in conjunction with the accompanying drawings wherein like references refer to like parts, wherein.

DETAILED DESCRIPTION OF EMBODIMENTS

Figure 1:
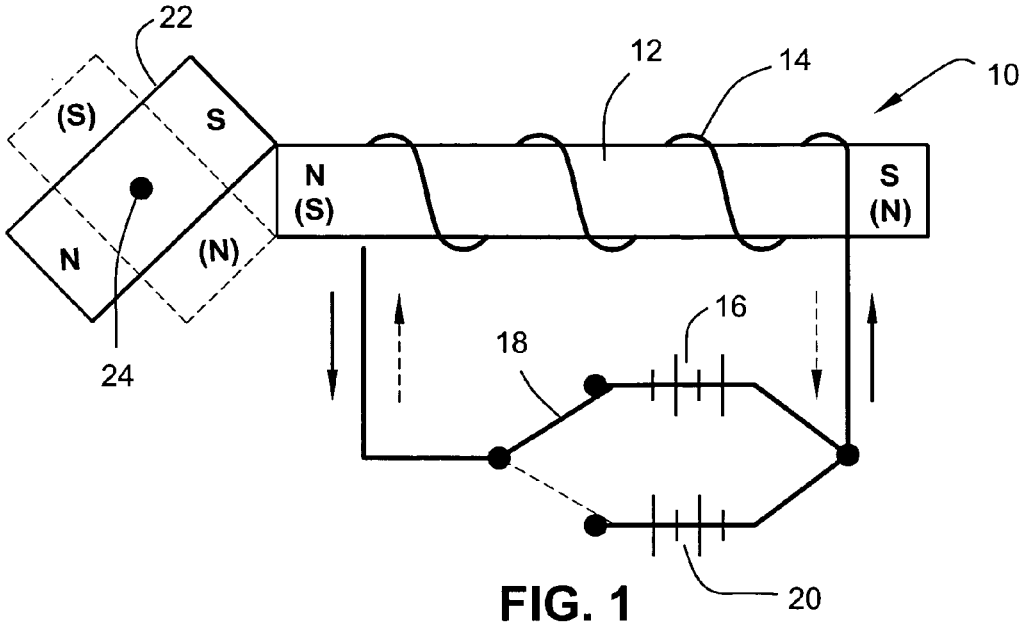
FIG. 1 is a schematic view of the electromagnet and permanent magnet portion of the present invention.

FIG. 1 shows an electromagnet 10 comprising a bar of ferromagnetic material 12 at least partially surrounded by a coil 14 which, when connected to a battery, causes current flow in one direction through the coil and thereby generate an electromagnetic field. If electricity is flowing from a power source (shown as a battery 16 but any direct current power source could be used) because switch 18 is in the solid line position, current will flow as indicated by the solid line arrows and will generate a magnetic field in the ferromagnetic material 12 having an effective north pole "N" on the left and a south pole "S" on the right.

If the switch is thrown to the dotted line portion so as to connect battery 20 (or merely reverse the polarity of a single battery), current will flow in the opposite direction as indicated by the dotted line arrows forming a south pole "(S)" at the left side of the ferromagnetic material 12 and a north pole "(N)" to the right. Thus, changing the polarity of current flow through the coil 14 at least partially surrounding the ferromagnetic material 12 will cause the electromagnetic field generated to be reversed.

Thus, the polarity of the electromagnet is north and south represented by "N" and "S" when powered by battery 16 with the switch in the solid line position. The polarity of the electromagnet with the switch in its dotted line position and powered by battery 20 is "(S)" and "(N)" as shown. Although two different batteries 16 and 20 are shown for illustrative purposes, in practice, generally only the polarity of the connection from a single power source to the electromagnet would be reversed.

Also disclosed in FIG. 1 is a permanent magnet 22 which is pivotally mounted for rotation about axis 24. It can be seen that with battery 16 connected to the electromagnet 10, the south pole of the magnet "S" will be attracted to the then north pole "N" of the electromagnet. However, once in that position, even if electrical power is interrupted from the battery 16, the magnet will remain "latched" in the solid line position shown in FIG. 1. This "latching" is due to the magnetic attractive force between either end of magnet 22 and the end of ferromagnetic material 12 even though the ferromagnetic material is no longer electromagnetically polarized (by current flowing through the coil 14).

When switch 18 is thrown to the dotted line position, battery 20 (or the reversed polarity in the more likely event that a single battery is used) will cause the flow of electricity through coil 14 to be reversed, thereby reversing the polarity of the electromagnet. Because the south pole "S" of permanent magnet 22 is adjacent the now south pole "(S)" of the electromagnet 10, the resultant repulsion between the same poles will cause the permanent magnet 22 to rotate counterclockwise about axis 24 until the north pole "(N)" of the permanent magnet is in contact with the then south pole "(S)" of the electromagnet.

Note that once the electromagnet has been energized by the battery 20 and switch 18 in the dotted line position and once the permanent magnet 22 has rotated more than halfway to its dotted line position, even if electricity to the electromagnet is interrupted, the magnetic attraction between pole "(N)" and the non-magnetized ferromagnetic material 12 will be attractive enough to not only complete the rotation of the magnet 22, but to "latch" or hold the magnet in the dotted line position in contact with or close to the ferromagnetic material 12.

Thus, from the above discussion, it can be seen that, depending upon which position switch 18 is in, magnet 22 will rotate to one or the other of its rest positions and, even if electricity to the electromagnet is interrupted, the magnet will remain "latched" in one of its pin extended or pin retracted positions by the attractiveness of the end of the permanent magnet to the non-magnetized ferromagnetic material 12.

It should be noted that as will be seen, there are numerous possible mechanical interactions between the location of coil 14, the ferromagnetic material 12 and the limited rotation of magnet 22 which will provide the same effect, i.e., rotation between two positions (which is dependent upon the polarity of current applied to the coil) and latching in one of at least two final positions (that provides the lowest impedance to flux flow through the permanent magnet and the ferromagnetic material). While two specific applications come to mind, those of ordinary skill in the art in view of the above will envision numerous other applications of the invention.

Figure 2:
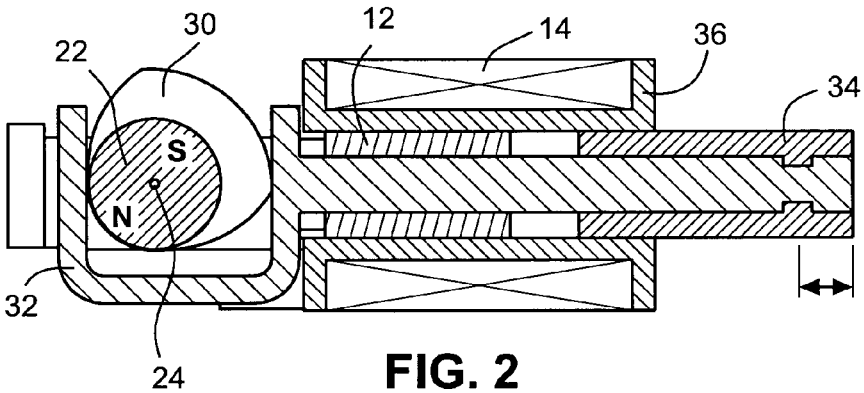
FIG. 2 is a side cross-sectional view of a cam actuated embodiment of the present invention in the pin extended position.
Figure 3:
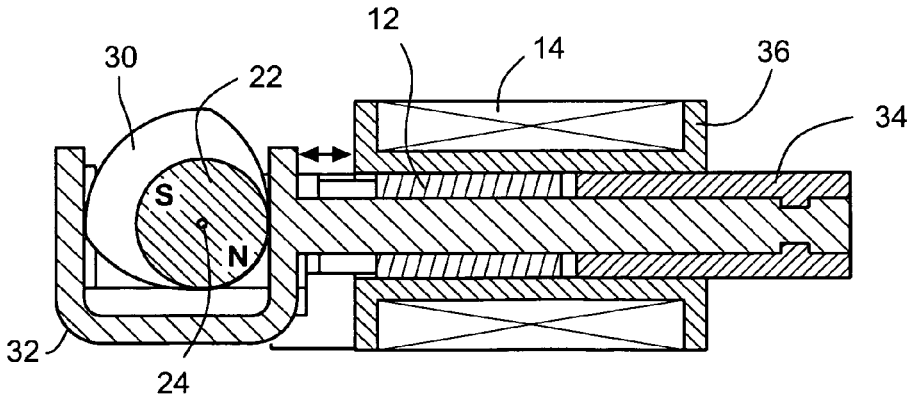
FIG. 3 is a side cross-sectional view of the cam actuated embodiment of the present invention shown in FIG. 2, but in the pin retracted position.

FIGS. 2 and 3 illustrate the same elements from FIG. 1 organized to provide an electromagnetically actuated bistable magnetic latching pin lock. Coil 14, as in FIG. 1, surrounds ferromagnetic material 12 which, when the coil is electrically activated, forms an electromagnet with north and south poles depending upon the direction of current flow through the windings 14.

Just as in FIG. 1, it will be seen that permanent magnet 22 is rotatable between two different positions. However, associated with the magnet 22 is a cam 30 which is also movable between the same two positions. A cam follower 32 converts the rotational movement of the cam 30 into longitudinal movement of the cam follower 32 which is constrained to move in only a longitudinal direction (which in this embodiment is coincident with the longitudinal axis of and movement of the pin lock 34).

In one embodiment, the cam is shaped so that it has portions which extend radially different distances from the axis of rotation 24, i.e., an outer portion having a larger radius and an inner portion having a smaller radius. Therefore, as it rotates from the position shown in FIG. 2 to the position shown in FIG. 3, the increasing radius on the left side of cam 30 will push the cam follower 32 to the left (and the decreasing radius on the right side of the cam 30 will permit the movement of the cam follower 32 to the left), retracting the pin lock to its retracted position as shown in FIG. 3.

To accomplish the movement of the pin lock from the pin extended position of FIG. 2 to the pin retracted position of FIG. 3, the correct winding direction in coil 14 and the correct current flow through that winding from an external power source (not shown) would be needed so as to establish an effective south pole at the left-hand portion of the ferromagnetic material 12. This effective "south" pole would repel the south pole portion of magnet 22 and attract the north pole portion, thereby rotating the magnet about axis 24 (just as in FIG. 1). Quite obviously to one of ordinary skill in the art in view of the Figures, the poles of the magnet 22 and the polarity of the electromagnet 10 could be reversed with the same effect and result.

The left-hand portion of the cam which contacts the cam follower 32 in FIG. 2 would, as the cam begins rotating counterclockwise, begin pushing the cam follower to the left, moving the pin lock from the extended position shown in FIG. 2 to the retracted position shown in FIG. 3. Quite clearly, if the current flow through coil 14 with the cam in the position shown in FIG. 3 is reversed, the effective north pole of ferromagnetic material 12 will be located on the left and will oppose the actual north pole of magnet 22 while at the same time attracting the south pole of magnet 22. Accordingly, the permanent magnet/cam combination will rotate clockwise about axis 24 from the retracted position shown in FIG. 3 to the extended position shown in FIG. 2.

As discussed above, the present invention uses the well known magnetic attractive force where a permanent magnet attracts as close as possible a ferromagnetic material as a latch to hold the cam, cam follower and pin lock in either of the two stable positions. The pin lock can be energized to move to the other position by applying a reversed electromagnetic field which causes rotation of the permanent magnet and cam as well as the cam follower to the reversed position.

However, if unconstrained, the permanent magnet would continue to rotate to a position aligned with the magnetic axis of the electromagnet, i.e., rotated clockwise approximately 45° further than the position shown in FIG. 1. If the electromagnet were energized with a repulsive field with the permanent magnet in such an aligned position, the magnet would virtually no rotational torque applied as the repulsion vector (between the end of the electromagnet and the permanent magnet) would be directly through the magnet's axis of rotation 24. So it is important to constrain the permanent magnet against rotation so as to be in alignment with the electromagnet in either of the pin extended and pin retracted positions.

Thus, if the axis of rotation of the permanent magnet were further to the left than that position shown in FIG. 1, the magnet would continue rotating in one direction until it was aligned with the axis of the electromagnet 10. This position would not only minimize any torque on the magnet if the field of the electromagnet were reversed, there would also be an ambiguity as to which direction the magnet would rotate. If the permanent magnet's rotation about axis 24 is constrained so as to prevent it from being completely aligned with the electromagnet, then it will always tend to rotate in only one direction when the electromagnetic field is reversed.

Additionally, preventing the permanent magnet from aligning with the ferromagnetic material also provides a positive attractive force between one end of the permanent magnet and the closest ferromagnetic material, tending to keep the magnet "latched" in position even if current through the coil 14 is interrupted. Since this can occur in either one of two stable positions as shown in FIG. 1, such device is considered to be "bistable," i.e., stable in two different positions even when the electromagnet 10 is de-energized.

Another feature of the embodiment shown in FIGS. 2 and 3 addresses the problem that often shock or vibration is applied to the pin lock 34. Such shock or vibration may tend to partially rotate magnet 22 which, if it rotated far enough, could then serve to overcome the magnetic attractive force and allow the pin lock to be inadvertently partially extended or partially retracted. If mechanically dislodged far enough, it might continue rotating until the other end of the magnet is latched without any electromagnetic actuation.

It will be seen that the cam 30 has an increasing radius slope to it that causes the cam follower movement during rotation of the cam in each of its two directions. However, in one preferred embodiment, at the end of its rotational travel, the cam has a small portion of its circumference that has a constant radius in contact with the cam follower. As a result of this constant radius portion, continued rotation of the cam results in no further movement of the cam follower and, conversely, forces on the end of the pin lock cannot provide any torque to the cam and magnet. In fact, if the radius of curvature decreases slightly, forces applied to the end of the pin lock would tend to rotate the cam towards staying in its latched position.

The constant radius portion of the cam 30 is shown in FIG. 2 as the portion of the cam actually in contact with the cam follower on the right-hand side and in FIG. 3 the portion of the cam in contact with the cam follower on the left-hand side. It will be seen in both FIGS. 2 and 3 that rotation of the cam clockwise in FIG. 2 and counter-clockwise in FIG. 3 will not result in further movement of the cam follower. When in these conditions, even the heaviest shock or vibrational impact on pin lock 34 will not result in any rotational force being applied to cam 30 and magnet 22 tending to dislodge the pin lock from the "latched" condition.

Additionally, it would be advantageous to inertially balance the cam about its axis of rotation, i.e., with the center of gravity of the cam/magnet combination being located substantially on the axis of rotation. It can be seen that, if the CG were substantially displaced from the axis of rotation, an acceleration having a component substantially perpendicular to the axis of rotation would generate a torque about the axis. This torque, if large enough could dislodge the magnet/cam combination from its latched position. Inertial balancing of the cam/magnet combination would help insulate the pin lock from being affected by externally forces and accelerations.

It will be understood that, if the cam were in the position midway between the extended position shown in FIG. 2 and the retracted position shown in FIG. 3, because of the non-constant radius (or slope) of the curve of the cam in contact with the cam follower, any longitudinal pressure provided on the pin lock would translate into a rotational moment applied about axis 24 to the magnet 22 and cam 30 combination. Thus, an area of essentially constant radius of curvature of cam 30 at each end of its rotational travel is a portion which does not provide additional longitudinal movement of pin lock 34 at either end of the cam rotation. The lack of longitudinal movement of the cam follower at the end of cam rotation (in either direction), insures that the cam 30 and magnet 22 are impervious to any longitudinal forces applied to the pin lock. As a result, the cam 30 remains biased by the magnetic attraction between the pole of magnet 22 which is closest to ferromagnetic material 12 and will remain in that position virtually insensitive to shock or vibration.

Thus, in the embodiment disclosed FIGS. 2 and 3, the travel of the cam follower is constrained so as to terminate movement of the cam and magnet to be in the desired pin extended and pin retracted positions. Alternatively, the cam and/or the magnet could have their rotational positions constrained to accomplish the same result.

The device shown in FIGS. 2 and 3 could be constructed using virtually any coil, coil wire or bobbin supporting the coil wire, any permanent magnet, any cam material and any cam follower material. In a preferred embodiment, Applicant has found success with utilizing a permanent magnet comprised of ceramic, samarium cobalt and/or neodymium.

It is also believed that the rotational movement of the magnet comprising essentially 90° from one position to the next may result in the largest rotational force on the magnet as well as the largest magnetic force on the magnet tending to keep it in its latched position when the coil is de-energized. Increasing the rotational movement of the magnet above 90° is an option and it permits a shallower cam face, but at the same time, the torque on the magnet created by the electromagnetic field during energization would be slightly less and the force latching the magnet into one of the two stable positions would be slightly less. Similarly, having a rotational movement of less than 90° would result in increased torque applied to the magnet and an increased latching force, but at the same time, would require a steeper cam face for the same amount of pin lock travel.

While different wire could be used in coil 14, Applicant uses 33 gauge copper conventional coil wire wound on a plastic (in one embodiment, 6/6 30% glass filled nylon) bobbin 36. The material of the cam and cam follower would be compatible materials with low mutual sliding friction and preferably non-ferromagnetic properties so as to interfere minimally with the field of permanent magnet 22. Additionally, it is not necessary that the magnet 22 be mounted on or in cam 30. Other mechanical interconnections will be readily apparent to those of ordinary skill and could include any number of devices for converting rotary to longitudinal motion, for example, a crank shaft and crank arrangement as in the internal combustion engine, and other similar devices.

If the pin lock is utilized as an actual locking pin and in one of its positions is designed to prevent movement of another structure, it would be advisable to utilize a strong mount through which pin lock 34 extends in FIG. 3 so that movement to the extended position shown in FIG. 2 allows only a slight additional portion of the pin lock to be exposed and has a sufficient portion of the pin lock retained within a robust structure so that shear forces applied to the pin lock are resisted. It is in this arrangement that the pin lock would be strongest at resisting relative movement between two structures and at the same time resisting vibrational or shock loads disrupting the "latched" operational interconnection. As shown, the pin lock can advantageously utilize a portion of the cam follower 32 while at the same time including an outer sleeve which may be hardened steel or other material capable of reducing deformation.

The arrangement of the cam 30, the cam follower 32 and the magnet 22 shown in FIGS. 2 and 3 represents a relatively short throw pin lock system, where the "throw" is the linear distance the pin lock travels from the extended to the retracted position (shown as the double ended arrow in FIGS. 2 & 3). In order to increase the throw of the pin lock system, the cam would have steeper cam faces and would be somewhat radially elongated. While the cam is pictured as encompassing the magnet 22, depending upon the desired throw, the magnet could radially extend beyond a portion of the cam, as long as the magnet was not located within the confines of the cam follower.

An additional modification of the pin lock 34 shown in FIGS. 2 & 3 could have the pin lock 34 extending to the left of and attached to the cam follower 32 (instead of through the hole in the ferromagnetic material 12 as shown). This has the advantage that the pin lock could be made of ferromagnetic material and the hole in ferromagnetic material 12 could be filled with additional ferromagnetic material, thereby improving the electromagnet's power. This embodiment would permit the pin lock to be directly joined with the cam follower and eliminate the need for the non-ferromagnetic shaft of the cam follower 32 to be joined to the hardened pin lock 34 as shown. This would also have the advantage of providing the mechanical pin lock operation on the left side of the device with the electrical coil connections on the right side.

The ferromagnetic material could be a low carbon steel or a magnetic stainless steel. Also an Alnico permanent magnet material could also be used because it can be easily magnetized and, due to its residual magnetism, it would end up appearing as a magnet attracted to the permanent magnet 22 and holding it in the latched position even more securely (the coil would then reversed the residual magnetic field when next activated). The material used for the pin lock itself will depend upon the application. The harder the material is, the more force that will be required to break it. There may be applications where a minimal shear strength is needed and for such applications the pin could be made of brass or even plastic.

Figure 4:
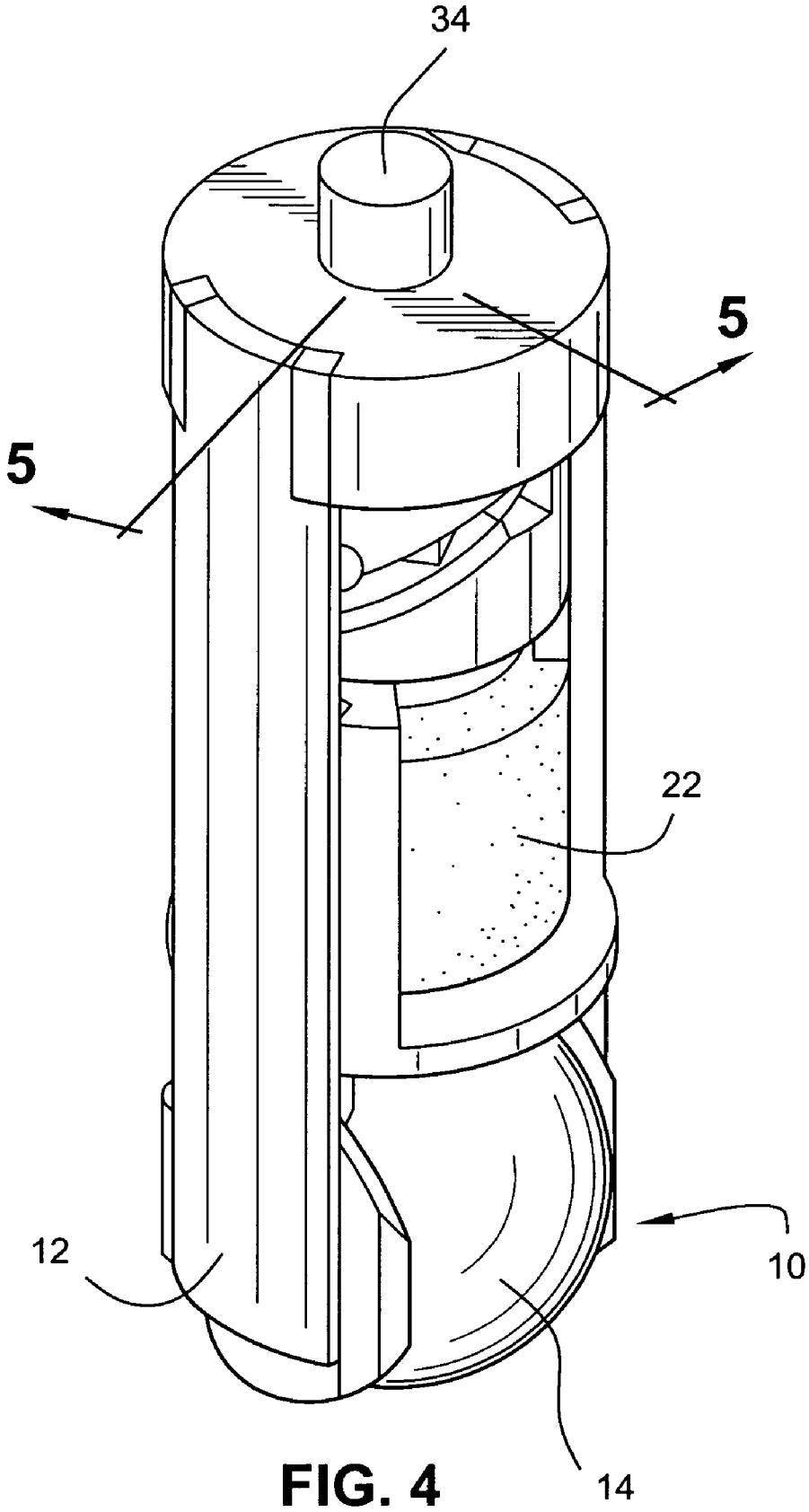
FIG. 4 is a perspective partially cut-away view of a sleeve actuated embodiment of the present invention.

Another embodiment of the present invention is shown in FIG. 4 and can be envisioned as follows by reference to FIG. 1. If, for example, the coil 14 of the electromagnet is concentrated at the center of the ferromagnetic material 12 and the end portions of the ferromagnetic material (not surrounded by the coil) are bent 90°, an essentially U-shaped form of the ferromagnetic material 12 is created with the coil at the bottom of the U and two upstanding arms of ferromagnetic material. That is essentially the configuration disclosed in FIGS. 4-9. In order to optimize the configuration, the portion of the ferromagnetic material passing through the coil would be cylindrical with somewhat flattened upstanding arms.

Figure 5:
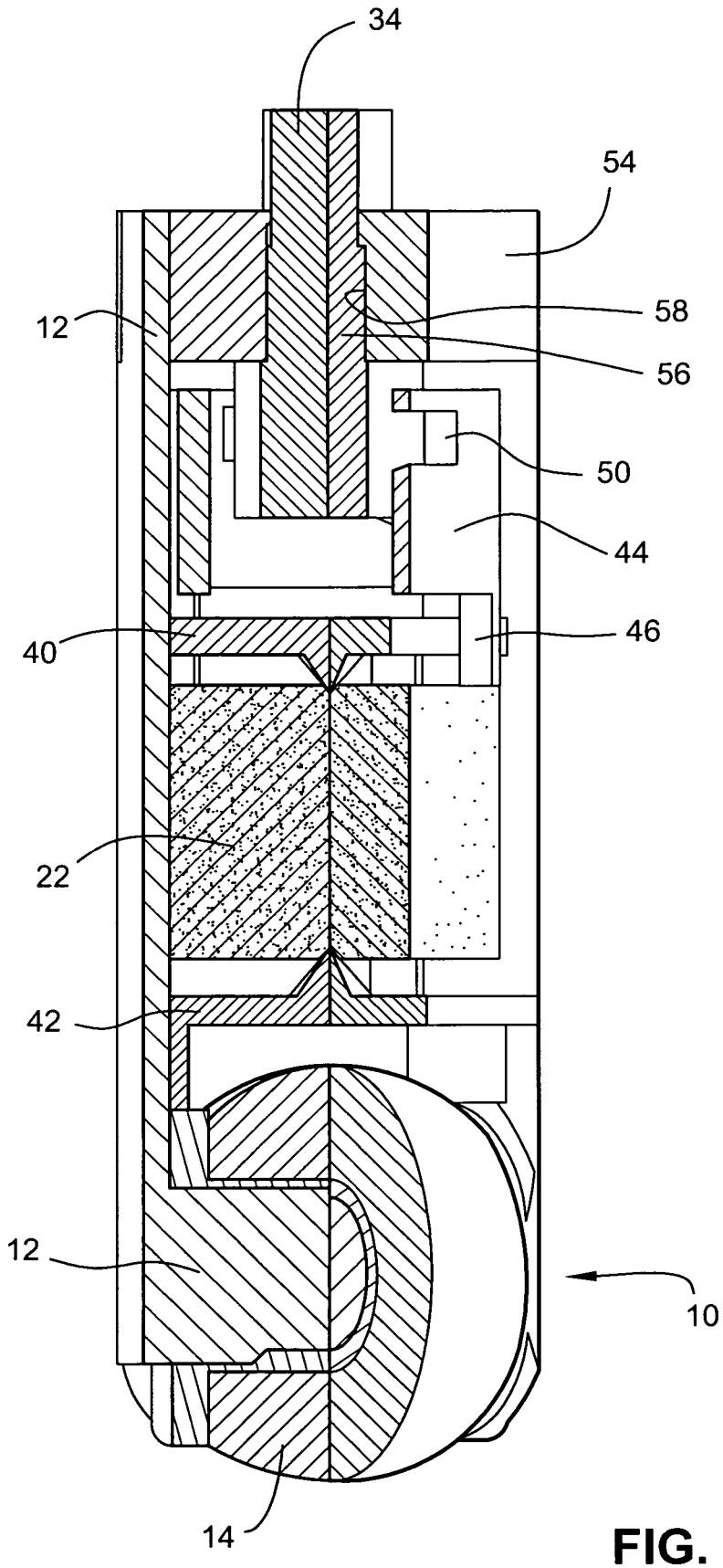
FIG. 5 is a side partially cut-away view of FIG. 4 along lines 5-5.

As can be seen in FIGS. 4 and 5, the windings of coil 14 are concentrated in a smaller volume and the ferromagnetic material 12 passing through the coil extends on either side of the coil longitudinally in the direction of the longitudinal axis of pin lock 34. Turning back to the FIG. 1 schematic drawing, it can be seen that one end of ferromagnetic material 12 is in close proximity to the rotatable magnet 22, but the field generated by the other end of the electromagnet is a significant distance from the permanent magnet and thus would be somewhat inefficient.

If the coil 14 is concentrated and the ferromagnetic material bent into a U-shape as discussed above, it can be seen that the other end of the ferromagnetic material could be located just to the left of the rotatable magnet 22. This would substantially increase the efficiency of the magnet in terms of its "latching" power, as well as increasing the rotational torque created by the magnet around axis 24 by having two poles which are either repelled and/or attracted.

Figure 6:
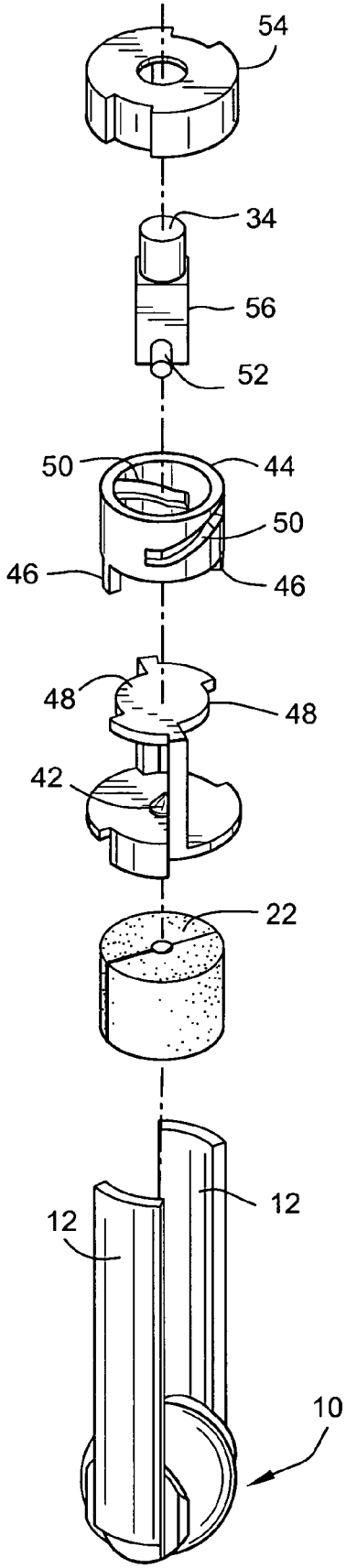
FIG. 6 is an exploded view of the elements of the sleeve actuated embodiment of the present invention.
Figure 7:
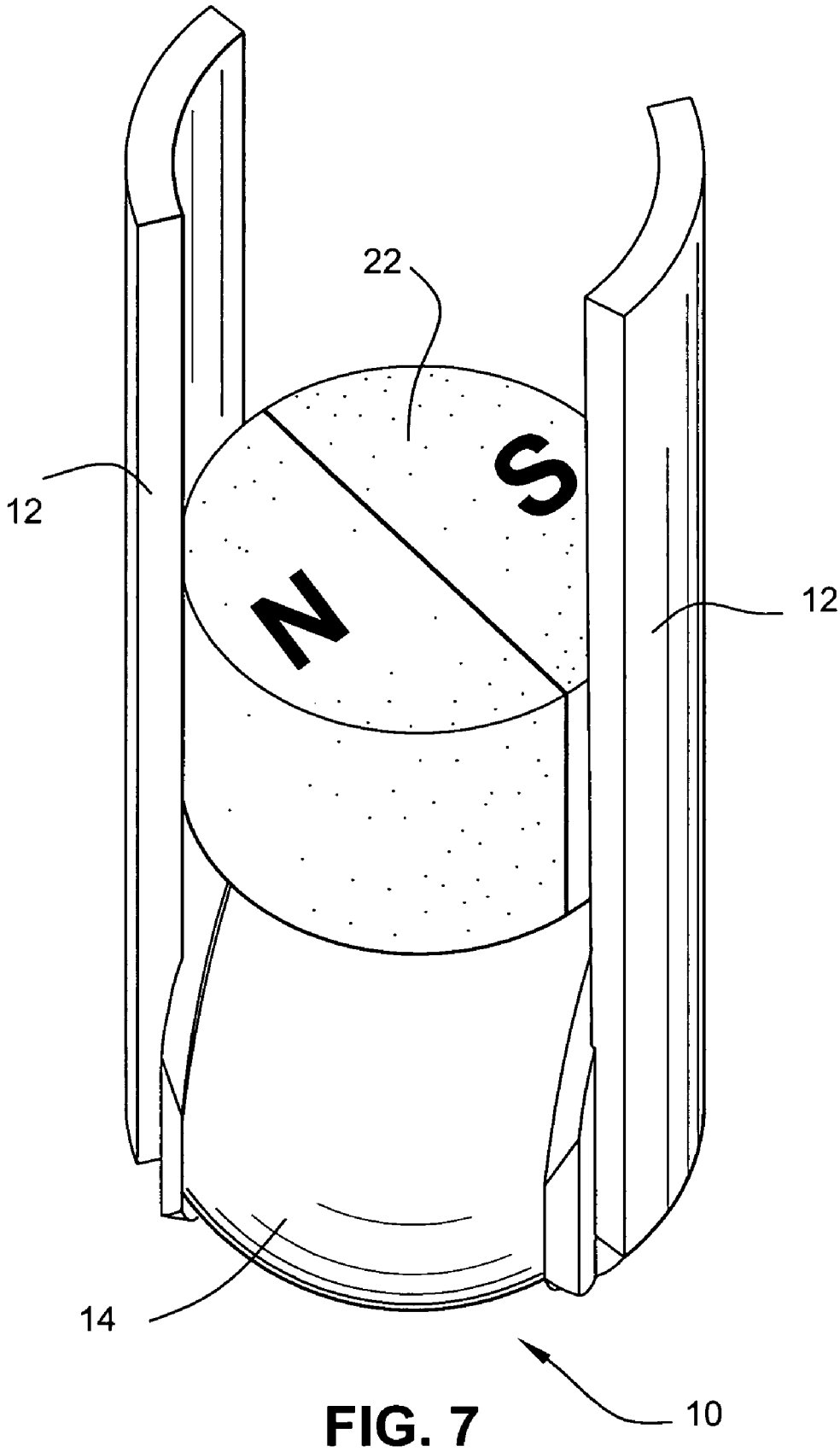
FIG. 7 is a view of the electromagnet, its ferromagnetic frame and the permanent magnet in one of the two latched positions.
Figure 8:
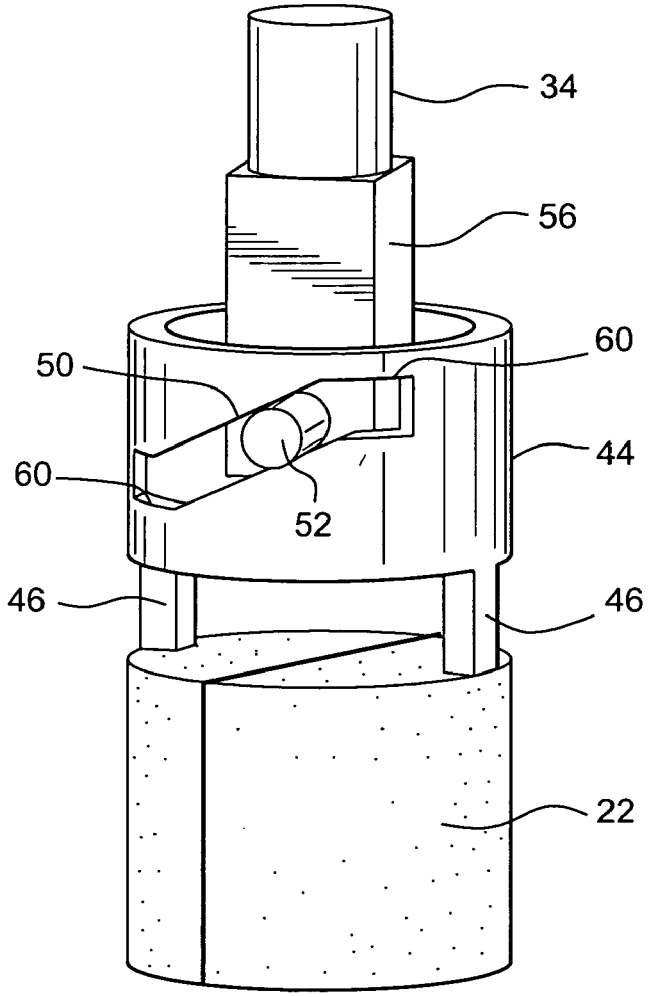
FIG. 8 is a perspective view of the permanent magnet, the sleeve and the pin lock portion of the sleeve actuated embodiment of the present invention.
Figure 9:
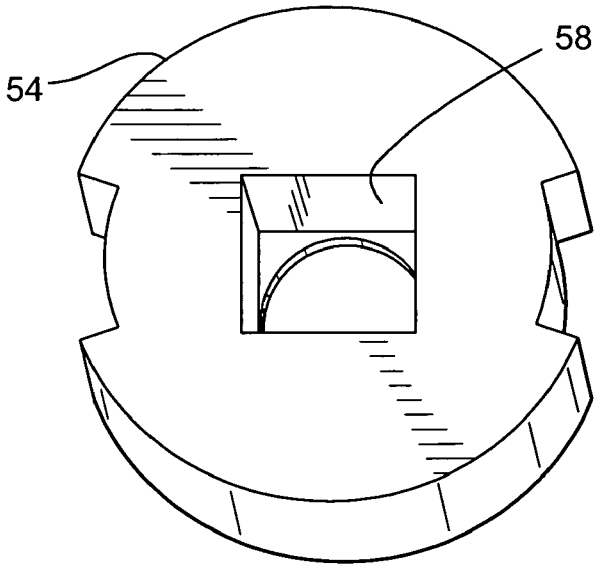
FIG. 9 is a perspective view of the pin lock mount for preventing rotation of the pin lock during movement along its longitudinal axis.

Thus, in the embodiment disclosed in FIGS. 4-9, magnet 24 is oriented as more clearly shown in FIG. 7 to have north and south poles on either side of a generally cylindrical shaped magnet and the magnet is mounted for pivotal rotation by upper pin mount 40 and lower pin mount 42. Although the pin mount is shown as a structure above magnet 22 in FIG. 6, when assembled as shown in FIG. 5, the magnet is mounted for rotation within a structure formed by the upper and lower pin mounts 40 and 42, respectively.

As can be seen by reference to FIG. 7, the magnet 22, without energization of the electromagnet, will tend to rotate so that the north and south poles are aligned directly between the two vertically upstanding ferromagnetic arms. The permanent magnet 22 is constrained against rotation to that position for the same reasons that it is restrained against alignment with the ferromagnetic material 12 in FIG. 1 and as discussed with respect to the FIGS. 2 and 3 embodiment. This way, when the electromagnet 10 is energized, the magnet will either be held in its existing position or will readily rotate to the new position and then be latched in that new position.

Attached to and rotatable with the electromagnet is a rotating sleeve 44 which, in one embodiment, may be attached to magnet 22 by legs 46. In a preferred embodiment, these legs may be long enough to extend past the upper pin mount 40 so as to contact and be affixed to the magnet 22 which is mounted for rotation between the upper and lower pin mounts 40 and 42, respectively, as shown in FIG. 5.

As part of the upper pin mount, it is noted that there are circumferential recesses in the upper pin mount structure which allow legs 46 to extend between the sleeve 44 and the magnet 22, which legs do not contact the pin mount except at the extremes of the rotational position. The recesses 48 and the interaction with legs 46 at the extremes of rotational position, serve to constrain the rotation and thus the latched position of the magnet at each end of its rotational movement.

Because sleeve 44 rotates with magnet 22, another mechanical interconnection structure is needed to convert the rotational movement of the magnet 22/sleeve 44 assembly to longitudinal movement of the pin lock 34 itself. This is provided by the sleeve having at least one helical slot contained therein and in the embodiment shown in FIG. 6, two helical slots 50 are provided. However, the helical slots could just as easily be helical grooves or threaded structures or other structure which will mechanically interconnect and transform the rotational movement of the magnet/sleeve combination to longitudinal movement of pin lock 34. The pin lock 34 could be made of the materials noted above, but, in view of its location in this embodiment, could also be made of ferromagnetic material as well.

In the embodiment shown in FIG. 6, instead of a cam and cam follower, Applicant discloses the helical slots 50 and pin followers 52 extending from the pin lock 34 and located within helical slots 50. Additionally, the embodiment of the pin lock 34 disclosed in FIGS. 4-9 has at least a lower portion with a shaped cross-section which, in combination with a similar shaped aperture in the mount, prevents rotation of the pin lock while permitting pin followers 52 to ride in slots 50 of the rotatable sleeve 44.

In one embodiment, this portion of the pin lock 34 is a square structure 56 which is compatible with a square portion aperture 58 of upper mount 54. Thus, the upper mount 54 serves to prevent rotation of pin lock 34 about its longitudinal axis as it moves along that axis. While a square structure and square aperture of the mount have been illustrated, clearly any geometrical shape which prevents rotation of the pin lock about its longitudinal axis would be an acceptable alternative.

In view of the operational interrelationship of the various elements shown in FIGS. 4-9, the operation of the embodiment illustrated therein will be readily apparent to one of ordinary skill in the art. The magnet in the position shown in FIG. 7 is in its latched position, with the magnet tending to force rotation so as to be aligned between the two portions of ferromagnetic material 12, but being constrained against such over-rotation by the legs 46 interfering with the end of the recess 48 in the upper mount 40.

As shown in FIG. 6, the pin followers 52 are in the lower portion of the grooves 50. From the detailed view in FIG. 8, at each end of helical slot 50, there is a non-helical portion of the slot 60—one at the upper portion and one at the lower portion of each slot. It will be readily apparent that the non-helical portions of the slot achieves the same purpose as the constant radius portion of the cam in the embodiment shown in FIGS. 2 and 3, i.e., it prevents longitudinal forces on pin lock 34 from tending to rotate the sleeve 44/magnet 22 combination. Thus, longitudinal force on the pin should not be able to rotate the magnet.

However, this non-helical slot portion is certainly optional and may be added to one or other or both ends of the helical slot 50 as desired where insulation from longitudinal pressure is desirable. It is noted that in FIG. 8 the pin follower 52 is shown approximately midway in its travel between the upper and lower non-helical slot portions.

Assuming that the magnet is oriented at one of the bistable latched positions, the pin follower in the preferred embodiment will be on the upper or lower portion of the non-helical slot 60. Energization of the electromagnet will either cause the magnet to maintain this position or, as discussed previously, the magnet to rotate. Because the orientation of the magnet is constrained to be not in line with the upstanding portions of ferromagnetic material 12, the magnet will rotate in only one direction, and that direction will be consistent with the sleeve rotating so as to force the pin follower to rotate the sleeve away from the non-helical slot portions 60, forcing the pin follower 52 upwards or downwards depending upon the initial starting position.

Because the pin lock 34 has a square structure 56 which moves longitudinally in an accompanying square portion 58 of mount 54, the pin lock only moves longitudinally and does not rotate about its longitudinal axis. Thus, energization of the coil in one direction will cause movement of the pin lock to its pin extended position and application of the opposite current will cause movement of the pin lock between its pin extended and pin retracted positions.

Of course, those of ordinary skill in the art in view of the two examples of the present invention will be readily aware of numerous mechanical assemblies for mounting a pin lock for linear movement, numerous examples of permanent magnets and mountings therefore for limited rotation, numerous versions of electromagnets having ferromagnetic material in arrangements which, when energized, will cause the magnet to rotate between positions, numerous ferromagnetic latches for latching the mounted magnet into one or the other of the two positions in the absence of actuation of the electromagnet itself and numerous mechanical interconnections between the magnet and the pin lock for translating rotational movement of the magnet into movement along the longitudinal axis of the pin lock. Accordingly, the present invention is limited only by the plain meaning of the words set out in the attached claims and equivalents thereof.

What is claimed is:

1. An electromagnetically actuated, bistable magnetic latching pin lock, said lock comprising:

a pin lock moveably mounted for linear movement along a longitudinal axis between a pin extended position and a pin retracted position;

a magnet having two pole ends, said magnet mounted for limited rotation about between said pin extended and pin retracted positions;

an electromagnet having first and second ends and electromagnetically actuated in one of said pin extended and pin retracted positions to provide one orientation of magnetic field and in the other of said pin extended and said pin retracted positions to provide a second orientation of magnetic field, said second orientation of magnetic field substantially the reverse of the first orientation of magnetic field, wherein actuation of said electromagnet biases said permanent magnet towards a field alignment rotation;

a ferromagnetic latch located within the magnetic field of said mounted magnet to latch the magnet into at least one of said pin extended and pin retracted positions in the absence of actuation of said electromagnet; and a mechanical interconnection between said pin lock and said magnet for moving said pin lock from said pin extended position when said magnet is in said pin extended position to said pin retracted position when said magnet is in said pin retracted position, said magnet is located in the magnetic field of said electromagnet and moveable between said magnet pin extended and pin retracted positions in dependence on the orientation of said electromagnet magnetic field.

2. An electromagnetically actuated pin lock according to claim 1, wherein said magnet is a permanent magnet.

3. An electromagnetically actuated pin lock according to claim 2, wherein said permanent magnet is comprised of at least one of ceramic, samarium cobalt and neodymium.

4. An electromagnetically actuated pin lock according to claim 1, wherein said rotational movement of said magnet comprises substantially 90 degrees from said pin extended position to said pin retracted position.

5. An electromagnetically actuated pin lock according to claim 1, wherein said ferromagnetic latch comprises ferromagnetic material positioned closer to one pole end of said magnet when the magnet is in the pin extended position and closer to the other pole end of said magnet when the magnet is in the pin retracted position and magnetic attraction between at least one pole end of the magnet and the ferromagnetic material latches the magnet in at least one of said two magnet positions.

6. An electromagnetically actuated pin lock according to claim 5, wherein the magnet and the ferromagnetic material latches the magnet in both of said two magnet positions.

7. An electromagnetically actuated pin lock according to claim 1, wherein said mechanical interconnection between said pin lock and said magnet comprises:

a cam rotatable with said magnet; and a cam follower associated with said pin lock, wherein when said cam is pivoted to said extended position, said cam moves said cam follower and said pin lock to said pin extended position and when said cam is pivoted to said pin retracted position, said cam moves said cam follower and said pin lock to said retracted position.

8. An electromagnetically actuated pin lock according to claim 7, wherein said cam has an area of substantially constant radius of curvature portion located on at least one end of the cam surface such that continued rotation of the cam does not result in additional longitudinal movement of the pin.

9. An electromagnetically actuated pin lock according to claim 7, wherein the cam has an area of substantially constant radius of curvature portion located on both ends of the cam surface such that continued rotation of the cam does not result in additional longitudinal movement of the pin at either end of the cam rotation.

10. An electromagnetically actuated pin lock according to claim 1, wherein said magnet has a longitudinal axis and said pin lock has a longitudinal axis, and said magnet axis is substantially transverse to said pin lock axis midway between said pin extended and pin retracted positions of said magnet.

11. An electromagnetically actuated pin lock according to claim 1, wherein said mechanical interconnection between said pin lock and said magnet comprises:

a sleeve connected to said magnet, said sleeve having a helical slot;

a mount for the pin lock, said mount permitting pin lock movement along its longitudinal axis and preventing rotation around said longitudinal axis; and said pin lock including a follower located in said slot, wherein rotation of said magnet causes rotation of said sleeve, said slot in turn causing said follower to move in the pin lock longitudinal direction between extended and retracted positions.

12. An electromagnetically actuated pin lock according to claim 11, wherein said helical slot has a non-helical flat portion flat on one end such that continued rotation of the sleeve does not result in additional longitudinal movement of the pin lock in at least one of the pin retracted and pin extended positions.

13. An electromagnetically actuated pin lock according to claim 11, wherein said helical slot has a non-helical flat portion on both ends such that continued rotation of the sleeve does not result in additional longitudinal movement of the pin lock in both the pin retracted and pin extended positions.

14. An electromagnetically actuated pin lock according to claim 1, wherein said magnet has an axis of rotation and said pin lock has a longitudinal axis, and said magnet axis is substantially parallel to said pin lock axis.

15. An electromagnetically actuated, bistable magnetic latching pin lock, said lock comprising:

a pin lock moveably mounted for linear movement along a longitudinal axis between a pin extended position and a pin retracted position;

a permanent magnet having north and south pole ends, said magnet pivotally mounted for limited rotation about an axis which is substantially transverse to said pin lock longitudinal axis, said rotation is between said pin extended and pin retracted positions;

an electromagnet having first and second ends and electromagnetically actuated in one of said pin extended and pin retracted positions to provide a first orientation of magnetic field and in the other of said pin extended and pin retracted positions to provide a second orientation of magnetic field, said electromagnet magnetic field at least partially encompassing said magnet, wherein actuation of said electromagnet biases said permanent magnet towards a field alignment rotation;

a ferromagnetic latch located within the magnetic field of said pivotally mounted magnet to latch the magnet into at least one of said pin extended and pin retracted positions in the absence of actuation of said electromagnet;

a cam rotatable by said permanent magnet between pin extended and pin retracted positions; and a cam follower engaging said cam and associated with said pin lock, said cam follower for moving said pin lock from one of said pin extended and pin retracted positions to the other of said pin extended and pin retracted positions, wherein said permanent magnet is located in the magnetic field of said electromagnet and is moveable between said magnet pin extended and pin retracted positions in dependence on the orientation of said electromagnet magnetic field.

16. An electromagnetically actuated pin lock according to claim 15, wherein said cam has an area of substantially constant radius of curvature portion located on at least one end of the cam surface such that continued rotation of the cam does not result in additional longitudinal movement of the pin.

17. An electromagnetically actuated pin lock according to claim 15, wherein the cam has an area of substantially constant radius of curvature portion located on both ends of the cam surface such that continued rotation of the cam does not result in additional longitudinal movement of the pin at either end of the cam rotation.

18. An electromagnetically actuated, bistable magnetic latching pin lock, said lock comprising:

a pin lock moveably mounted for linear movement along a longitudinal axis between a pin extended position and a pin retracted position;

a permanent magnet having pole ends, said magnet pivotally mounted for limited rotation about an axis substantially parallel with said longitudinal axis, said rotation is between said pin extended and pin retracted positions;

an electromagnet having first and second ends and electromagnetically actuated in one of said pin extended and said pin retracted positions to provide a first orientation of magnetic field and the other of said pin extended and pin retracted positions to provide a second orientation of magnetic field, said second orientation of magnetic field substantially the reverse of the first orientation of magnetic field, wherein actuation of said electromagnet biases said permanent magnet towards a field alignment rotation;

a ferromagnetic latch located within the magnetic field of said pivotally mounted magnet to latch the magnet into at least one of said pin extended and pin retracted positions in the absence of actuation of said electromagnet; and a sleeve connected to said magnet, said sleeve having a helical slot;

a mount for the pin lock, said mount permitting pin lock movement along its longitudinal axis and preventing rotation around said longitudinal axis; and said pin lock including a follower located in said helical slot, wherein rotation of said magnet causes rotation of said sleeve, said slot in turn causing said follower to move in the pin lock longitudinal direction between extended and retracted positions, wherein said permanent magnet is located in the magnetic field of said electromagnet and is moveable between said magnet pin extended and pin retracted positions in dependence on the orientation of said electromagnet magnetic field.

19. An electromagnetically actuated pin lock according to claim 18, wherein said helical slot has a flat on one end such that continued rotation of the sleeve does not result in additional longitudinal movement of the pin lock in at least one of the pin retracted and pin extended positions.

20. An electromagnetically actuated pin lock according to claim 18, wherein said helical slot has a flat on both end such that continued rotation of the sleeve does not result in additional longitudinal movement of the pin lock in both the pin retracted and pin extended positions.

* * * * *